United States Patent [19]

Machacek et al.

[11] 4,068,320

[45] Jan. 17, 1978

[54] METHOD OF PRODUCING KNITTED SLACKS

[75] Inventors: Frantisek Machacek, Strelice; Vladislav Bezemek, Brno; Dusan Kudlacek, Brno; Lubomir Kliment, Brno; Arnost Pirek, Brno; Vladimir Smejkal, Brno; Frantisek Svoboda, Brno; Stanislav Vach, Brno, all of Czechoslovakia

[73] Assignee: Vyzkumny ustav pletarsky, Brno, Czechoslovakia

[21] Appl. No.: 672,241

[22] Filed: Mar. 31, 1976

[30] Foreign Application Priority Data

Apr. 2, 1975 Czechoslovakia ..... 2232/75

[51] Int. Cl.[2] ..... A41D 1/06

[52] U.S. Cl. ..... 2/227; 2/243 R

[58] Field of Search ..... 2/227, 79, 409, 243 R, 2/69, 228; 66/177; 161/411, 402; 26/69 R, 69 A

[56] References Cited

U.S. PATENT DOCUMENTS

| | | | |
|---|---|---|---|
| 957,893 | 5/1910 | Marville | 2/409 |
| 2,826,760 | 3/1958 | Rice | 2/409 |
| 3,763,499 | 10/1973 | Bartos et al. | 2/227 |
| 3,852,827 | 12/1974 | Gilbert, Jr. | 2/409 |

FOREIGN PATENT DOCUMENTS

| | | | |
|---|---|---|---|
| 1,510,099 | 12/1967 | France | 2/227 |
| 2,097,617 | 3/1972 | France | 2/227 |
| 2,421,518 | 11/1975 | Germany | 2/227 |

*Primary Examiner*—H. Hampton Hunter

[57] ABSTRACT

Knitted outerwear slacks produced of thermoplastic fibers, of permanently finished natural fibers, or of a thermoplastic and natural fiber blend. Both legs of the slacks are of seamless tubular knitted fabrics shaped by molding and terminated on one or both ends in a double welt, the legs being connected together by one seam in the crotch portion.

The invention also relates to a method of producing knitted outerwear slacks of thermoplastic fibers, of permanently finished natural fibers, or of a thermoplastic and natural fiber blend. The method comprises knitting on a medium diameter circular knitting machine two seamless tubular knitted fabrics one after the other, the circumference of the machine being equal to one trouser leg circumference, the trouser legs having a double welt. Said tubular knitted fabrics are separately heat-molded on individual molds to the final shape of the trouser legs. Both trouser legs are connected together by one seat seam in the crotch portion of the slacks, the remaining material is cut from the crotch portion, and the slacks are finished by making-up operations.

6 Claims, 4 Drawing Figures

METHOD OF PRODUCING KNITTED SLACKS

This invention is related to the subject matter disclosed and claimed in copending and coassigned U.S. patent applications Ser. No. 621,773, filed Oct. 14, 1975 to MUSIL ET AL, Ser. No. 636,432, filed Dec. 1, 1975 to ZOUHAR ET AL, and Ser. No. 641,642, filed Dec. 17, 1975 to KEJNOVSKY ET AL.

This invention relates to knitted outerwear slacks produced from thermoplastic fibers, permanently finished, natural fibers, or a thermoplastic and natural fiber blend, and to a method of producing the same.

Knitted outerwear slacks are known; methods of producing the same are also known, mostly according to conventional methods, i.e., by means of complicated operations involving slitting the original fabric into a number of individual parts and sewing these parts into the shape of slacks, as well as pressing or ironing the slacks to the final shape. This technology has been adopted essentially ever since the production of knitted slacks of natural fibers as well as of outerwear slacks consisting of thermoplastic synthetics, even when fabrics of thermoplastic fibers permit the use of more progressive methods owing to their advantageous physical and mechanical properties.

The disadvantages of conventional methods of producing knitted outerwear slacks consist mainly in the complicated and tedious processes in the cutting rooms and making-up departments, it being necessary to perform the predominant part of these operations manually, thus requiring a large number of skilled workers at low productivity.

In the knitted industry thermoplastic fibers have been used first of all for underwear, especially for hosiery. That is why the molding and heat-setting of articles of this type is well known, as well as the knitting of pantyhoses which are made in one piece or which consist of several parts on special circular knitting machines with subsequent heat setting on forms.

It is also known to produce knitted slacks of thermoplastic fiber according to simplified patterns such as a quadrangle-shaped fabric or a tubular one, thus eliminating the steps of the fabric to the desired shape and into several parts, as well as the sewing of these parts together. In this case, the semi-finished garment is put on a form on which it is extended in the body; this step is followed by shrinking the semi-finished garment on the form. Slacks of this type have a connecting seam inside the trouser legs toward the crotch, and a further connecting seam extending on the body part from the crotch to the waist.

Slacks produced by this method require, however, a special extensible and simultaneously shrinkable thermoplastic knitted fabric, thus limiting to some extent the use of said method. At the same time such slacks have an incontrollable degree of heat setting.

According to another known method the semi-finished garment is produced of a thermoplastic extensible tubular fabric which is flat folded and cut along the longitudinal axis and in both layers in the crotch part, or which is of a rectangular quadrangle shape the selvedges of which are folded toward its longitudinal axis. Said fabric is then slit in the lower part along the longitudinal axis in the crotch part, and the adjacent middle selvedges of the leg parts are subsequently connected by the inseam, thus forming trouser legs. When the original fabric is of a rectangular quadrangle shape, the adjacent selvedges in the crotch - waist section are connected by a further seam. After being turned inside out, the resulting slacks are put on a heat setting form and molded to the desired shape by heat setting.

According to another method wherein slacks are made consisting of one or several parts of an optional thermoplastic fabric, slacks are produced by sewing together two leg parts each having an outer and inner or middle selvedge, thus forming trouser legs with a crotch seam and a front seat seam. Such slacks require an essentially lower material consumption, and require less labor than hitherto known slacks.

Based on an also known method of producing underwear and outerwear, body-size circular knitted fabrics of thermoplastic yarns are slit into single open tubular cuts, the latter being subsequently heat set on heated molding forms and adjusted to the final shape by cutting and making-up operations.

Outerwear slacks are produced similarly, the original basic fabric also being a body-size tubular knitted fabric; the fabric is put with its back face on a heated molding form and heat set subsequently producing in the first step unseparated trouser legs by one U-shaped double seam in the middle of the body-size tubular knitted fabric. After this the trouser legs are separated by slitting the double seam. In the finishing step, the slacks are turned inside out, which means again to the face side.

The object of the present invention is to eliminate said disadvantages and substantially to reduce the labor required in production while achieving optimum material consumption.

In accordance with the invention this is achieved by knitting the outerwear slacks while using thermoplastic fibers, permanently finished natural fibers or a thermoplastic and natural fiber blend. In accordance with the invention, the two trouser legs are made of seamless tubular knitted fabrics shaped by molding and terminated on one or both ends in a double welt, the legs being connected with each other by one seam in the seat part.

In one embodiment the seamless tubular knitted fabric has a lower density in the seat, or in the lower part of the trouser legs, the standard density being employed in the knee parts of the slacks.

Besides unshrinkable yarn, tubular knitted fabrics may contain shrinkable yarn in an optional knitted fabric part while at least one hem of the knitted fabric may contain elastic yarns.

The methods of producing knitted fabrics according to the invention are characterized in that on a medium diameter circular knitting machine two seamless tubular knitted fabrics one after another are produced, the circumference of each being equal to one leg circumference, the same having a double welt; these tubular knitted fabrics are then heat molded individually on separate molds to a final shape of the trouser legs. The legs are subsequently connected with each other by one seat seam in the slacks crotch portion, the remaining material of the seat being cut off and the slacks then finished by making-up operations. It is of advantage automatically and continuously to change the density according to a predetermined program when knitting the tubular fabric.

The termination of the lower and/or the upper hem of the slacks in a double welt is of advantage since then no making-up operations are needed to finish this slack part.

In some slack types according to the invention, an elastic waist band is produced, or in case of sport slacks, the so-called "knickerbockers", i.e. an elastic termination of the lower slack hem is provided by knitting-in elastic yarns or rubber threads. Thus, also in these cases the making-up of the hem is eliminated.

Automatic continuous change of the knitted fabric density according to a predetermined program facilitates a better fashioning and ensures a more perfect fit of the final garment. Parts of the semi-finished garment being knitted with lower density are more extensible, thus facilitating putting the garment on the mold. Such lower density can be made use of in these parts of the semi-finished garment which are to be stretched on molds according to the desired shape of the final garment, e.g. in the seat part. On the other hand, it is advantageous to use a higher density in those parts of the semi-finished product — tubular fabrics — where no substantial extension by molding takes place, e.g. in the knee parts.

The remaining fabric from the seat part can be further utilized for patch pockets, etc.

The objects and advantages of the invention will be more readily apparent from the following description and from the accompnaying drawing setting forth two preferred embodiments of the knitted slacks according to the invention.

In the drawings

Figure 1:
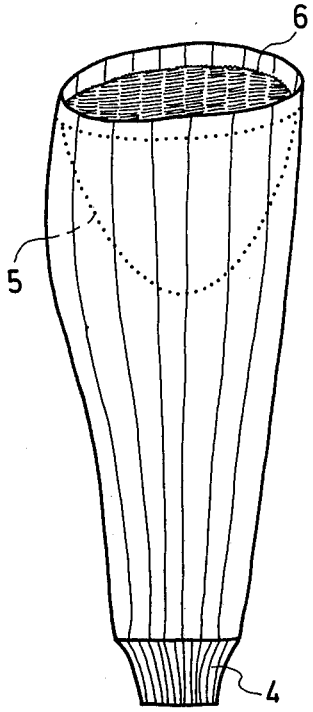
FIG. 1 is a side view.
Figure 2:
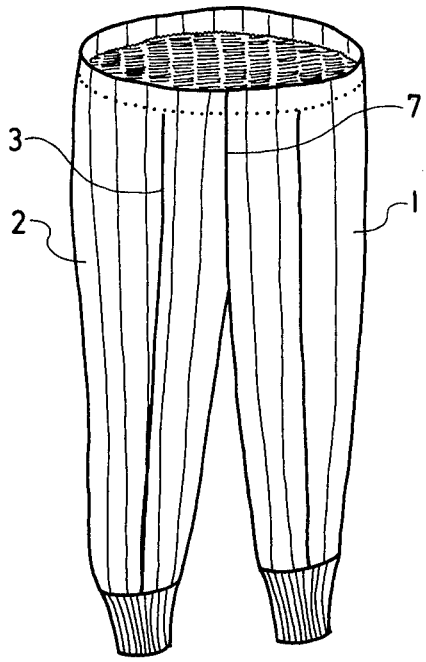
FIG. 2 is a front view of sport slacks, so-called "knickerbockers"

Turning now to FIGS. 1 and 2, there are shown tubular knitted fabrics 1, 2 each having a circumference equal to one leg circumference, fabrics 1 and 2 each having creases 3, i.e. molding marks on the front and rear side. The tubular knitted fabrics 1 which have an elastic lower hem 4 of an elastic yarn, or contain a knitted-in rubber thread, are connected with each other by one seam 5 in the crotch portion.

In the case of an elastic lower hem, the upper hem of the slacks is terminated in a double welt 6. A zipper 7 can be inserted into the front crotch part.

Figure 3:
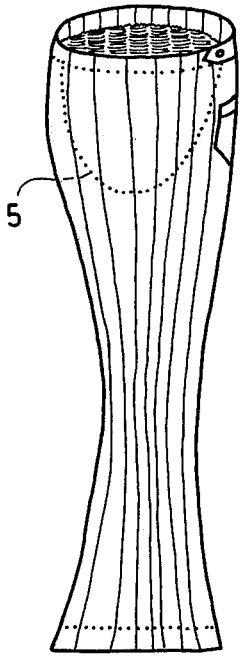
FIG. 3 is a side view and FIG. 4 is a front view of leisurewear slacks.
Figure 4:
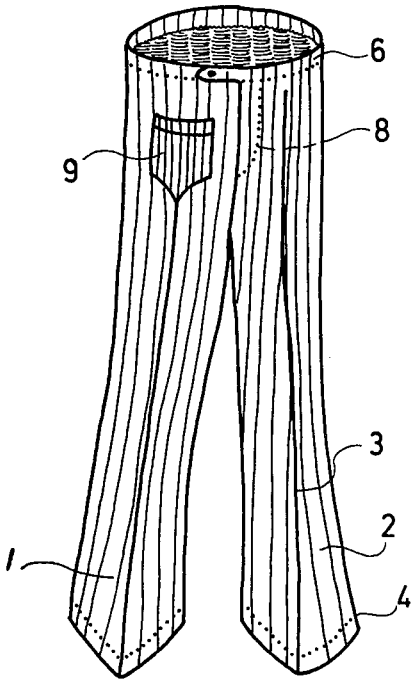

FIGS. 3 and 4 schematically illustrate leisurewear slacks. These also consist of two tubular knitted fabrics 1, 2, the circumference of each being equal to the circumference of one trouser leg and having creases 3 in the front and rear parts of both trouser legs 1, 2, the same being connected together by one seam 5 in the crotch portion. Each trouser leg 1, 2 is teminated in its lower part in a double welt 4. The upper end 6 of the slacks is formed by a waistband with a buckle, supplemented by a fly 8 and a patch pocket 9. When using a double welt in the slacks waist, the lower end of the trouser leg is plain.

Various methods of producing knitted outerwear slacks according to the invention are illustrated in the following examples.

EXAMPLE 1

Seamless tubular single knits with small Jacquard patterns (plain) are knitted one after another on a circular knitting machine, the cylinder diameter being preferably 7.5, 5.5 to 9.5, inches using 167 dtex 36×2 textured polyester filament yarn (100 percent synthetics), of a desired length, e.g. 110 cm. First of all, a double welt is knitted, this being the lower hem of the trouser leg. To facilitate molding to the necessary trouser leg shape, the fabric density is changed continuously, being lower by 20 - 40 percent in the seat part, or in the bell part, too. The basic density, i.e. the densest knitted fabric, is in the knee part of the trouser legs.

The seamless tubular knitted fabric produced by this method are individually heat molded on molds of the desired shape.

Subsequently, the excess material in the seat part of each individual seamless tubular knitted fabric - trouser legs - is cut away, the tubular knitted fabrics being connected pair-wise by one seat seam. The slack waistband is a funnel-type one suitable for a flat elastic band.

EXAMPLE 2

Seamless tubular single knits to form the trouser legs are produced according to the method in Example 1 using, however, a synthetic and natural fiber blend so that e.g. each even-numbered feeder is threaded with a natural fiber yarn, or synthetics forming the prevailing part of the blend which also contains cellulose staple or natural fibers.

In another embodiment it is possible to use overall man-made rayon, or natural fibers having a special finish to impart permanent shape to the garment by molding. The modes of molding the trouser legs, connecting by sewing as well as making-up correspond to those of Example 1.

EXAMPLE 3

Seamless tubular single knits designed for the trouser legs are produced according to the method described in Examples 1 and 2, wherein a combination of some aforementioned yarn types, i.e. for example in each even-numbered feeder a shrinkable material, e.g. a high shrinkable staple yarn is used. The molding of the trouser legs, and the connecting by sewing as well as the making-up operations correspond to Example 1.

EXAMPLE 4

Slacks according to the invention are produced according to Example 1, the double welt forming the waist and the lower end being unhemmed, or being hemmed by a conventional making-up operation.

EXAMPLE 5

Slacks according to the invention are produced according to Examples 1 and 4, both leg hems being produced with a double welt made directly on the knitting machine.

EXAMPLE 6

Slacks according to the invention are produced according to Examples 1 and 5, an elastic thread being knitted-in into one or both welts of the semi-finished garment or into the double welts.

EXAMPLE 7

Slacks according to the invention are produced according to Examples 1 and 6, the elastic thread being knitted-in in an optional trouser legs part, e.g. under the knee.

EXAMPLE 8

Slacks according to the invention are produced according to Example 1, the front slack part having a fly and a zipper.

Although the invention is illustrated and described with reference to a plurality of preferred embodiments thereof, it is to be expressly understood that it is in no way limited to the disclosure of such a plurality of embodiments, but is capable of numerous modifications within the scope of the appended claims.

What is claimed is:

1. Method of producing knitted outerwear slacks of thermoplastic fibers, of permanently finished natural fibers, or of a thermoplastic and natural fiber blend, comprising knitting on a medium diameter circular knitting machine to seamless tubular knitted fabrics one after another, the circumference of the fabric being equal to one trouser leg circumference, the trouser legs having at least at one of their ends a double welt, separately heat molding said tubular knitted fabrics on individual molds to the final shape of the trouser legs, and then connecting both trouser legs together by one seat seam in the slacks seat and crotch portion, cutting away the remaining material between said seam and the waistline of said slacks to form the crotch portion, and finishing the slacks by making-up operations.

2. A method according to claim 1, comprising continuously changing the density of at least one part of the tubular fabrics while they are being knitted.

3. A method according to claim 2, wherein the changing of density takes place automatically according to a predetermined program.

4. A method according to claim 2, wherein the tubular fabric forming the seat parts of the trouser legs is being knitted at a lower density and the tubular fabric forming the lower pants and knee parts of the trouser legs are being knitted at a higher basic density than the density of the remainder of the tubular knitted fabrics by varying the stitch length.

5. A method according to claim 1, wherein shrinkable and non-shrinkable threads are used in knitting at least one part of the tubular fabric forming the trouser legs.

6. A method according to claim 5, wherein at least one welt of the tubular fabric forming the trouser legs is being knitted with elastic threads.

* * * * *